US011221160B2

(12) United States Patent
Fabrizio

(10) Patent No.: US 11,221,160 B2
(45) Date of Patent: Jan. 11, 2022

(54) WALL SLEEVE

(71) Applicant: Chronomite Laboratories, Inc., City of Industry, CA (US)

(72) Inventor: Edward V. Fabrizio, Rancho Cucamonga, CA (US)

(73) Assignee: Chronomite Laboratories, Inc., City of Industry, CA (US)

( * ) Notice: Subject to any disclaimer, the term of this patent is extended or adjusted under 35 U.S.C. 154(b) by 91 days.

(21) Appl. No.: 16/356,432

(22) Filed: Mar. 18, 2019

(65) Prior Publication Data

US 2020/0300505 A1 Sep. 24, 2020

(51) Int. Cl.

| | |
|---|---|
| ***F24H 9/02*** | (2006.01) |
| ***F24H 9/06*** | (2006.01) |
| ***F24H 1/10*** | (2006.01) |

(52) U.S. Cl.

CPC ..... *F24H 9/02* (2013.01); *F24H 1/101* (2013.01); *F24H 9/06* (2013.01)

(58) Field of Classification Search

CPC ..... F24H 9/02; F24H 9/06; H02G 3/08

USPC ..... 220/3.8; 312/242; 49/504, 505

See application file for complete search history.

(56) References Cited

U.S. PATENT DOCUMENTS

| | | | | |
|---|---|---|---|---|
| 1,050,924 | A * | 1/1913 | Dowd | E06B 1/20 49/505 |
| 3,892,911 | A * | 7/1975 | Codrino | H02G 3/16 174/59 |
| 5,931,325 | A * | 8/1999 | Filipov | H02G 3/081 174/57 |
| 6,800,806 | B1 * | 10/2004 | Grday | H02G 3/126 174/50 |
| 8,251,253 | B1 * | 8/2012 | Cleghorn | H01H 9/02 220/844 |
| 2002/0112869 | A1 * | 8/2002 | Kobayashi | H05K 5/0073 174/50 |
| 2007/0225079 | A1 * | 9/2007 | Cole | G07F 17/32 463/46 |
| 2009/0180768 | A1 * | 7/2009 | Moore | F24D 17/0078 392/485 |
| 2013/0319715 | A1 * | 12/2013 | Korcz | H02G 3/08 174/50 |
| 2017/0040786 | A1 * | 2/2017 | Gross | H02G 3/086 |

* cited by examiner

*Primary Examiner* — Stephen J Castellano
(74) *Attorney, Agent, or Firm* — Eric J. Sosenko; Jonathan P. O'Brien; Honigman LLP

(57) ABSTRACT

A wall sleeve for recessed mounting into an opening in a wall. The wall sleeve includes a top sidewall, a bottom sidewall, a left sidewall, a right sidewall and a rear wall that cooperatively defines an enclosure with an enclosure opening located opposite of the rear wall. Each of the sidewalls have identical configurations, including portions defining at least one access opening and portions defining at least one mounting opening. The mounting openings having an effective diameter smaller than an effective diameter of the access openings.

16 Claims, 9 Drawing Sheets

WALL SLEEVE

BACKGROUND

1. Field of the Invention

The present invention generally relates to housings that are recess mounted within a wall. More specifically, the invention relates to a housing adapted for recess mounting in wall, as may be used for the mounting of an electric tankless water heater.

2. Description of Related Art

Currently, when mounting an electric tankless water heater so as to be recessed into a wall, a metal plate is mounted behind two wall studs and an opening is framed with metal or wood studs to define the opening in the wall. An access door is then mounted to the framing studs to cover the installation.

Such an installation is manually intensive, time consuming and complicated, and is also difficult in an application to an existing wall.

SUMMARY

In satisfying the above need, as well as overcoming the enumerated drawbacks and other limitations of the related art, the present invention provides a wall sleeve for mounting an electric tankless water heater within a recess of a wall.

In one aspect, a wall sleeve is provided that includes a top sidewall, a bottom sidewall, a left sidewall, a right sidewall and a rear wall. The right sidewall extends between and connects one end of the top sidewall to a corresponding end of the bottom sidewall. The left sidewall extends between and connects an opposing end of the top sidewall to a corresponding opposing end of the bottom sidewall. The top sidewall extends between and connects one end of the right sidewall to a corresponding end of the left sidewall, while the bottom sidewall extends between and connects an opposing end of the right sidewall to a corresponding opposing end of the left sidewall. A rear wall extends between and connects together the top sidewall, the bottom sidewall, the right sidewall and the left sidewall to cooperatively define an enclosure having an enclosure opening located opposite of the rear wall. Each of the top sidewall, the bottom sidewall, the right sidewall and the left sidewall have identical configurations, including portions defining at least one access opening and portions defining at least one mounting opening. The mounting openings having an effective diameter smaller than an effective diameter of the access openings.

In another aspect, each of the access openings of the top sidewall, the bottom sidewall, the right sidewall and the left sidewall are a first access opening and each of the each of the top sidewall, the bottom sidewall, the right sidewall and the left sidewall each include portions defining a second access opening.

In a further aspect, the second access openings are identical in size and shape to the first access openings.

In an additional aspect, the first and second access openings are positioned closer to the rear wall than the enclosure opening.

In still another aspect, the access openings are positioned closer to the rear wall than the enclosure opening.

In yet a further aspect, an access door mounted to the enclosure opening of the enclosure.

In still an additional aspect, the access door includes a frame, a bezel mounted to the frame and a cover door.

In another aspect, each of the sidewalls of the enclosure includes mounting openings, the access door being mounted to the enclosure through the mounting openings.

In still a further aspect, the mounting openings are in the form of slots.

In an additional aspect, the slots extend away from the enclosure opening toward the rear wall.

Further objects, features and advantages of this invention will become readily apparent to persons skilled in the art after review of the following description, including the claim, with reference to the drawings that are appended to and form a part of this specification.

DETAILED DESCRIPTION

As used in the description that follows, directional terms such as "upper" and "lower" are used with reference to the orientation of the elements as presented in the figures. Accordingly, "upper" indicates a direction toward the top of the figure and "lower" indicates a direction toward the bottom of the figure. The terms "left" and "right" are similarly interpreted. The terms "inward" or "inner" and "outward" or "outer" indicate a direction that is generally toward or away from a central axis of the referred to part whether or not such an access is designated in the figures. An axial surface is therefore one that faces in the axial direction. In other words, an axial surface faces in a direction along the central axis. A radial surface therefore faces radially, generally away from or toward the central axis. It will be understood, however, that in actual implementation, the directional references used herein may not necessarily correspond with the installation and orientation of the corresponding components or device.

Figure 1:
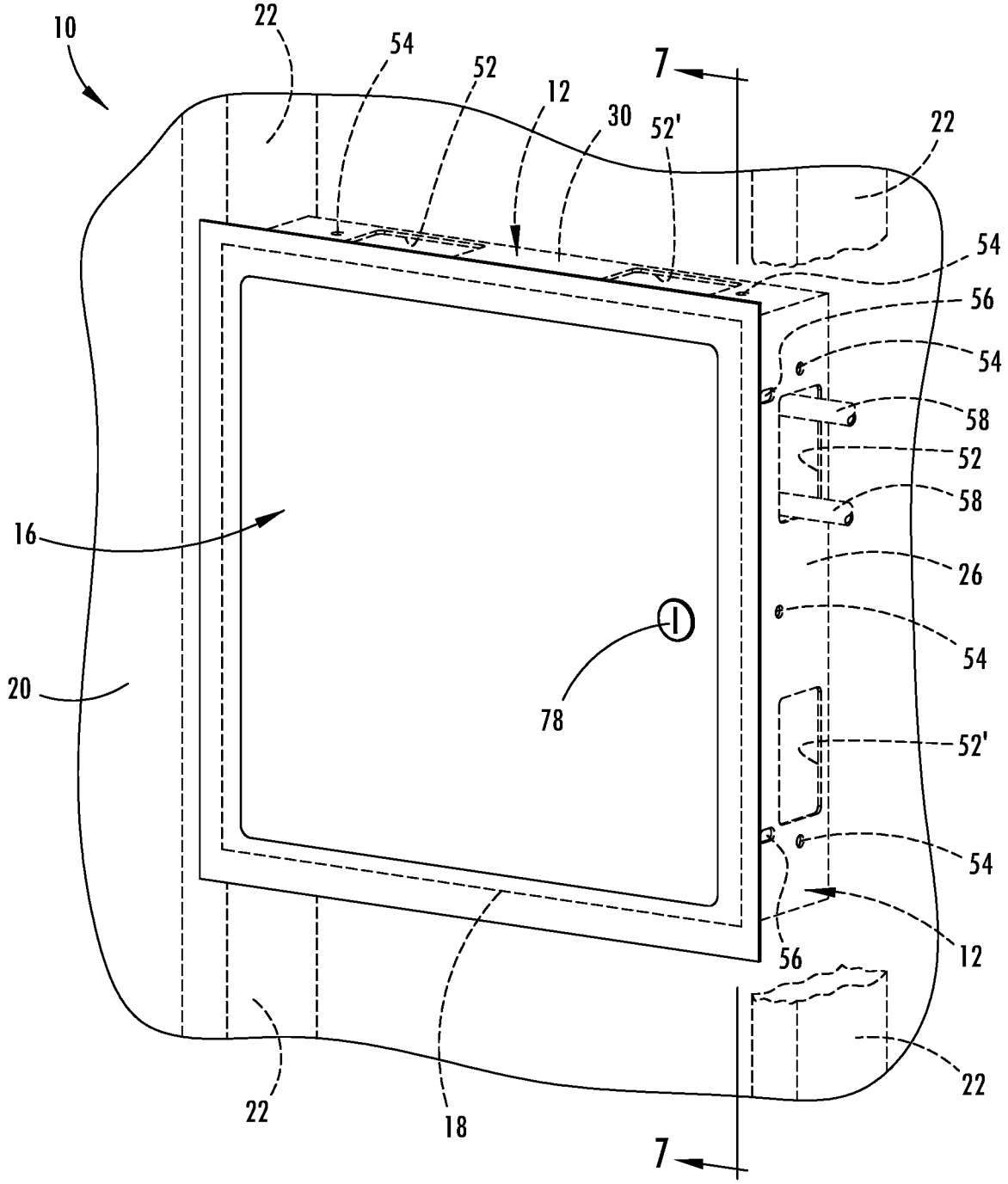
FIG. 1 is a perspective view of a wall sleeve, incorporating the principles of the present invention, recessed mounted within the wall of a structure and having an access door provided therewith.

Referring now to the drawings, a wall sleeve embodying the principles of the present invention is generally illustrated in FIG. 1 and designated at 10. The wall sleeve 10 includes various walls that cooperate to define an enclosure 12 with a front opening 14. This is seen in FIG. 3A. In a majority of the figures, the enclosure 12 is illustrated with an access door 16 over the front opening 14. It is to be understood, however, that the providing of such an access door 16 is an optional addition to the enclosure 12.

Figure 2:
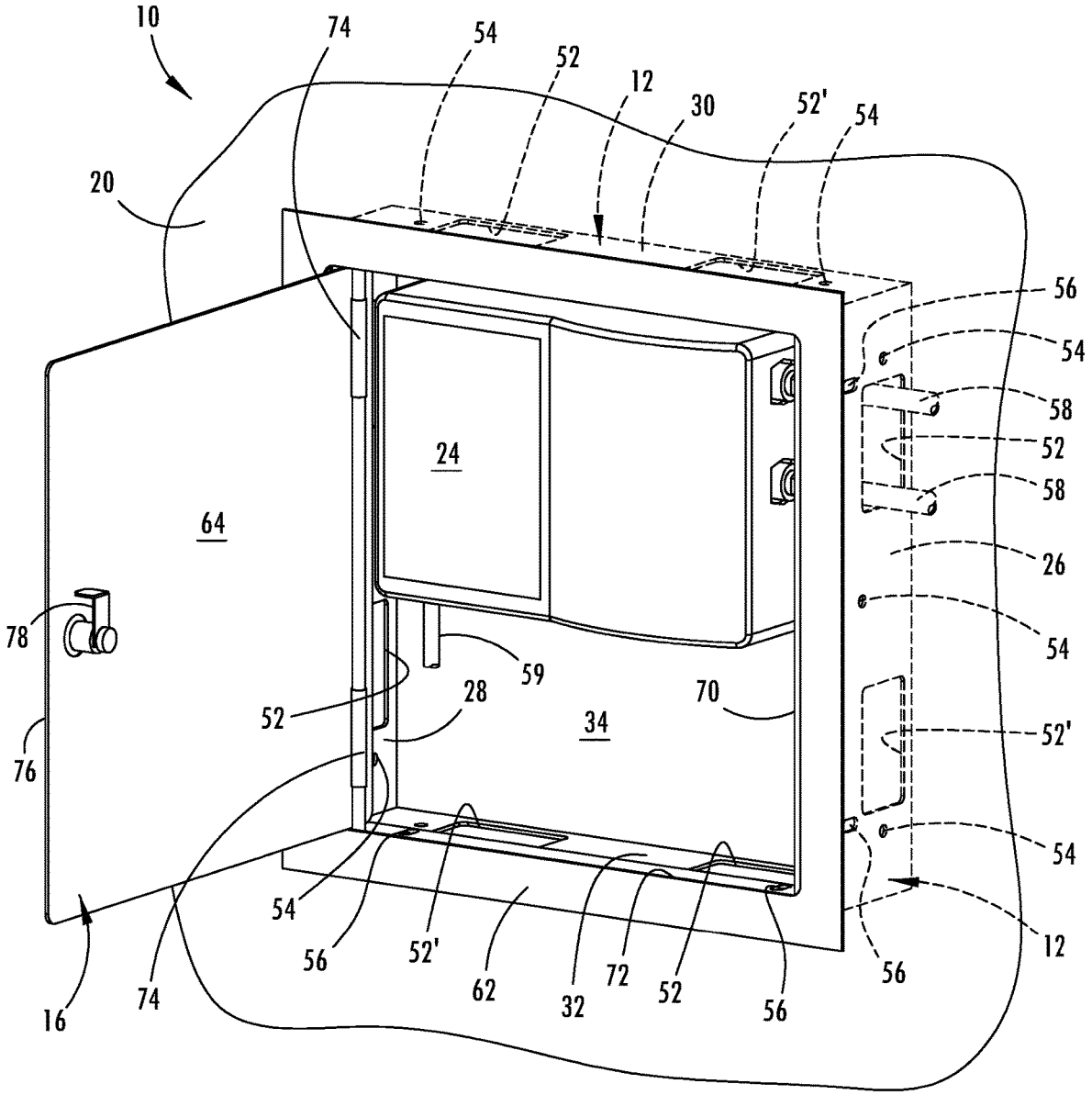
FIG. 2 is a perspective view of the wall sleeve seen in FIG. 1, with the access door in an open position and showing an electric tankless water heater positioned therein.
Figure 2A:
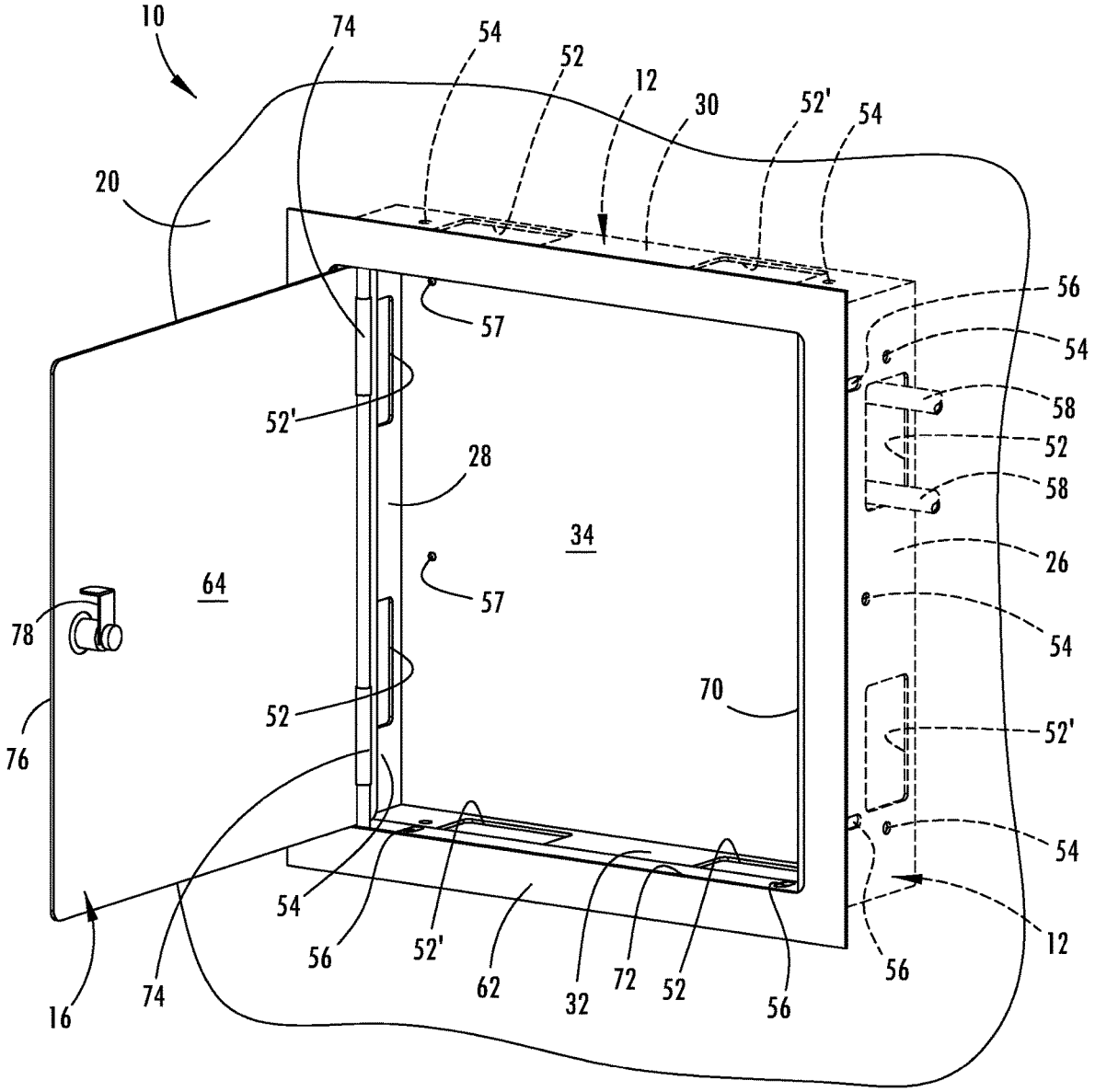
FIG. 2A is a perspective view of the wall sleeve seen in FIG. 2, without the electric tankless water heater.

Referring now to FIGS. 1, 2 and 2A, the wall sleeve 10 is configured to be received within an opening 18 formed in a wall 20. As further discussed below, once inserted into the opening 18 of the wall 20, the wall sleeve 10 may be secured to wall studs 22 or other framework provided within the wall 20. For convenience and simplicity in the drawings, the wall opening 18 and wall studs 22 are only illustrated in FIG. 1 and are shown therein using phantom or dashed lines.

Figure 5:
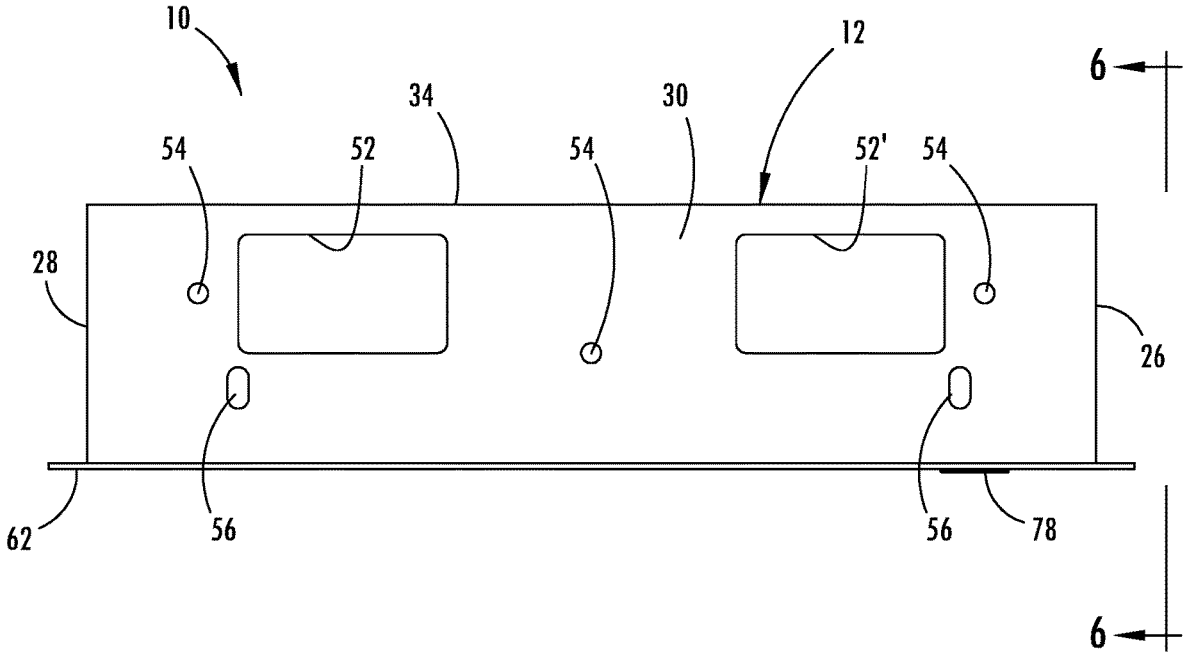
FIG. 5 is a top plan view of the wall sleeve seen in FIG. 1, with the access door mounted thereto and the electric tankless water heater positioned therein.
Figure 6:
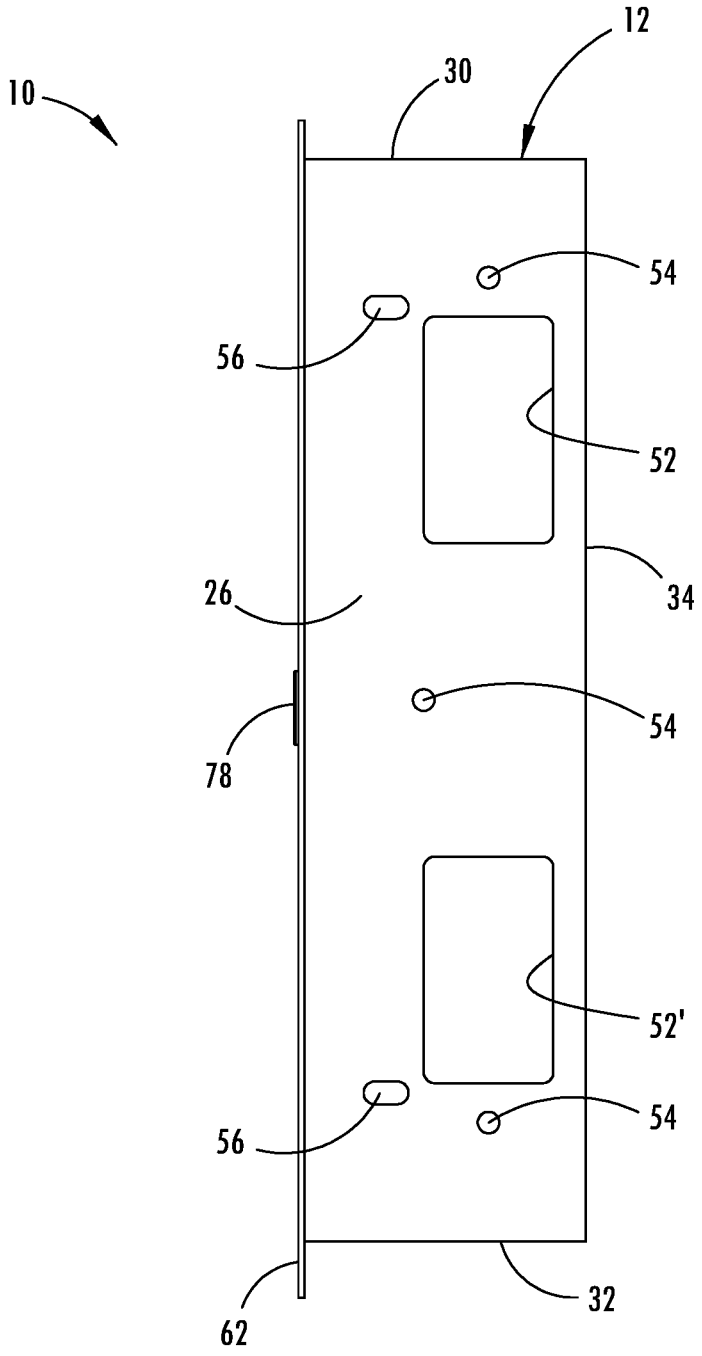
FIG. 6 is a right side plan view of the wall sleeve, generally taken from line 6-6 in FIG. 5, with the access door mounted thereto and the electric tankless water heater positioned therein.
Figure 7:
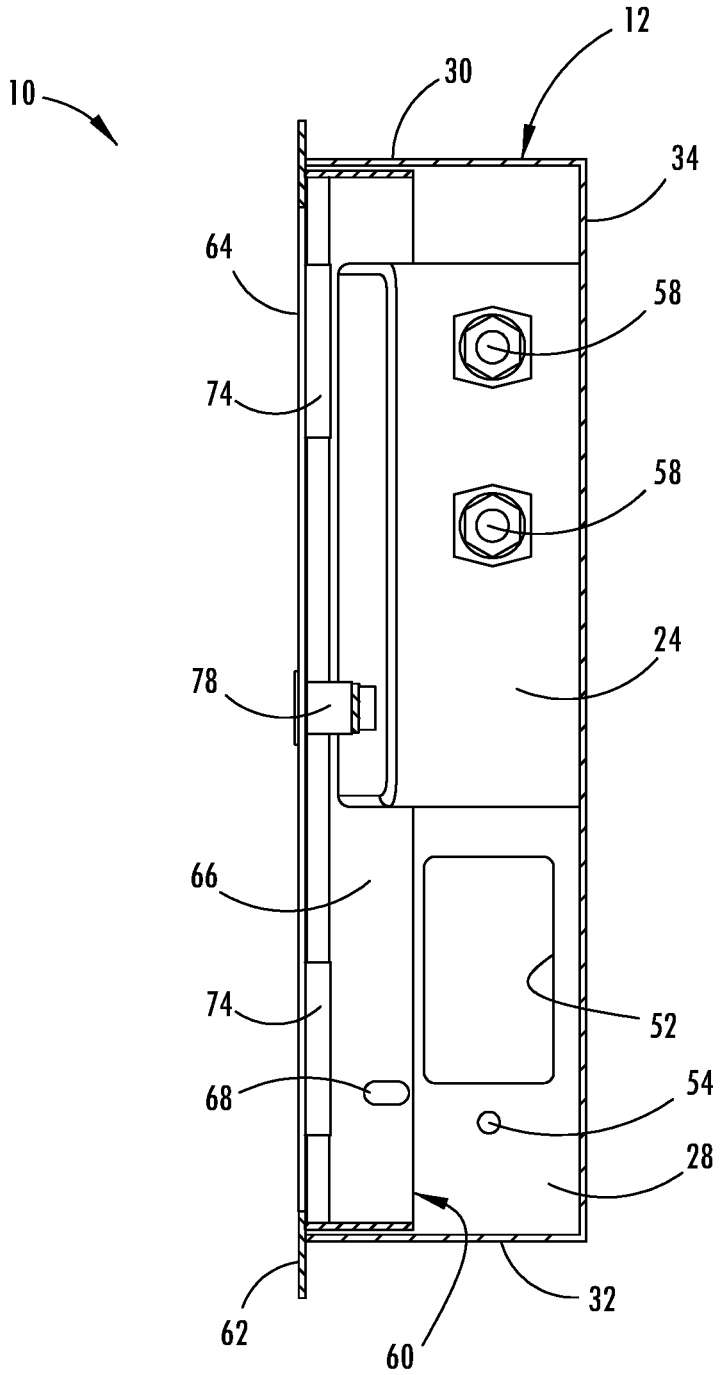
FIG. 7 is a cross sectional view of the wall sleeve, generally taken along line 7-7 in FIG. 5, with the access door mounted thereto and the electric tankless water heater positioned therein.

The wall sleeve 10 allows an electric tankless water heater 24 or similar device to be mounted in a recessed position within the wall 20. Such an electric tankless water heater 24 is readily seen in FIG. 2, wherein the access door 16 of the wall sleeve 10 is open, and in FIG. 7, which is a cross sectional view through the right end of the wall sleeve 10, generally along line 7-7 of FIG. 5.

Figure 3:
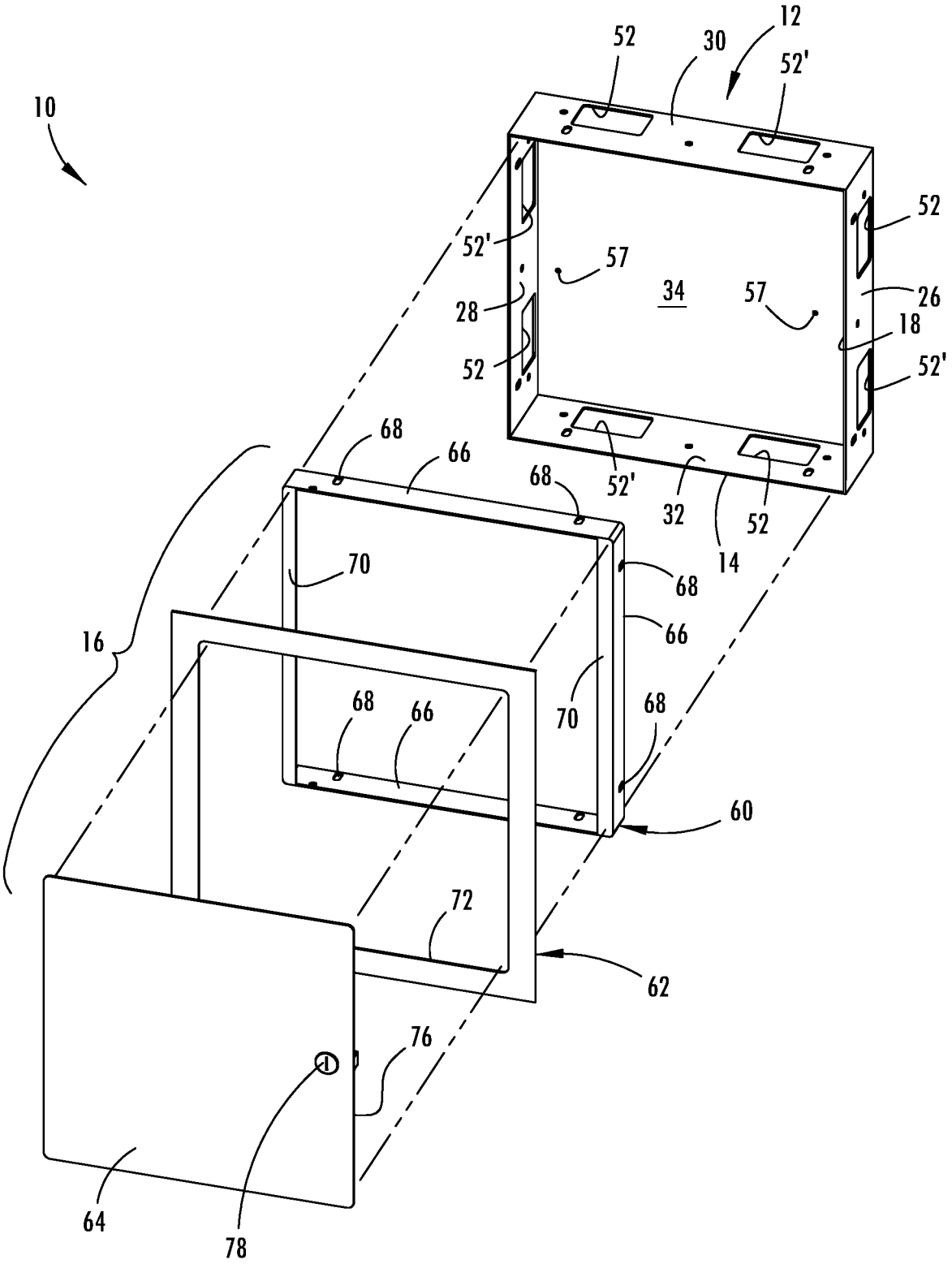
FIG. 3 is an exploded view of a wall sleeve, incorporating the principles of the present invention, in conjunction with an electric tankless water heater and an access door.
Figure 3A:
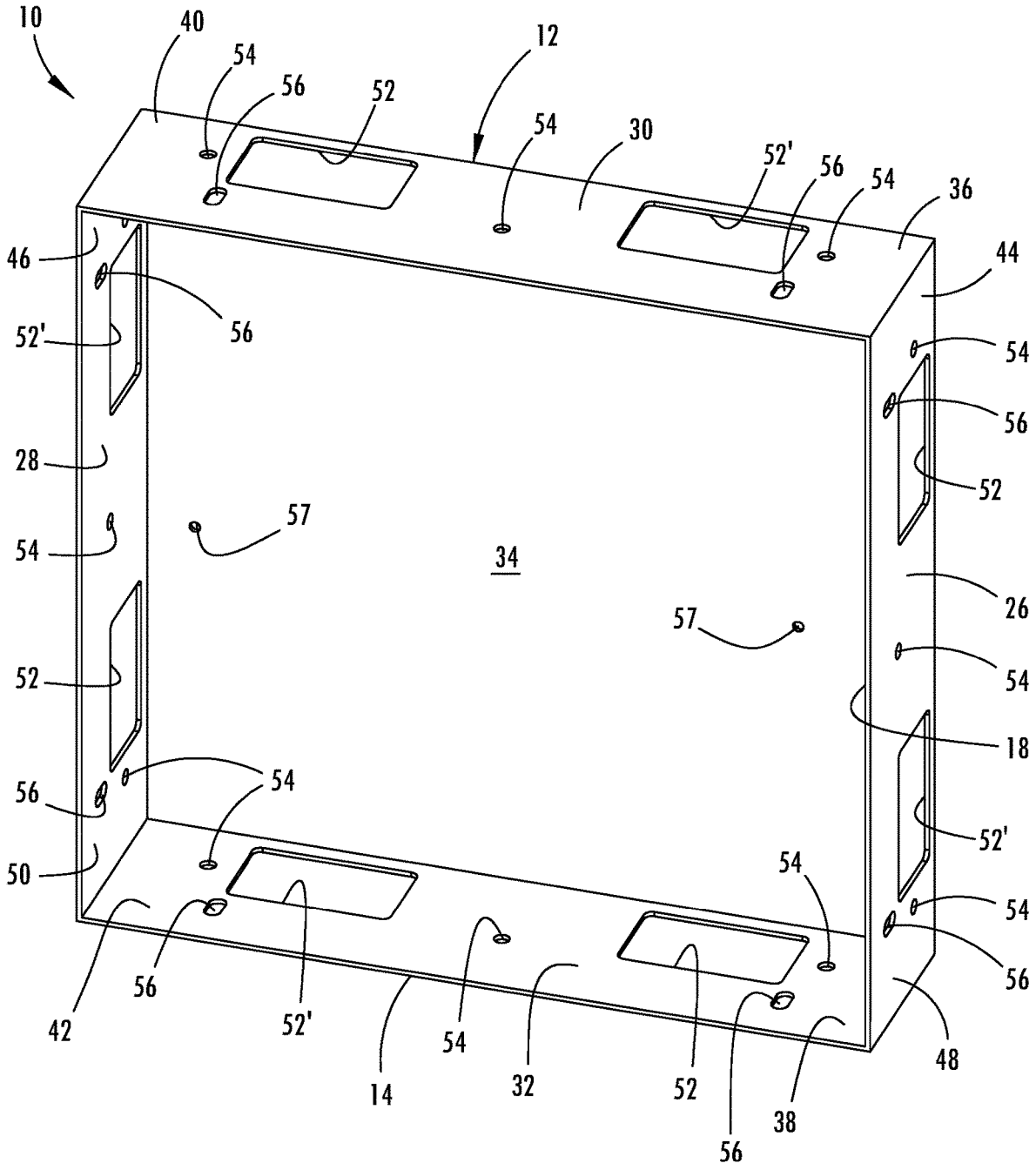
FIG. 3A is a perspective view of the wall sleeve without inclusion of an access door.
Figure 4:
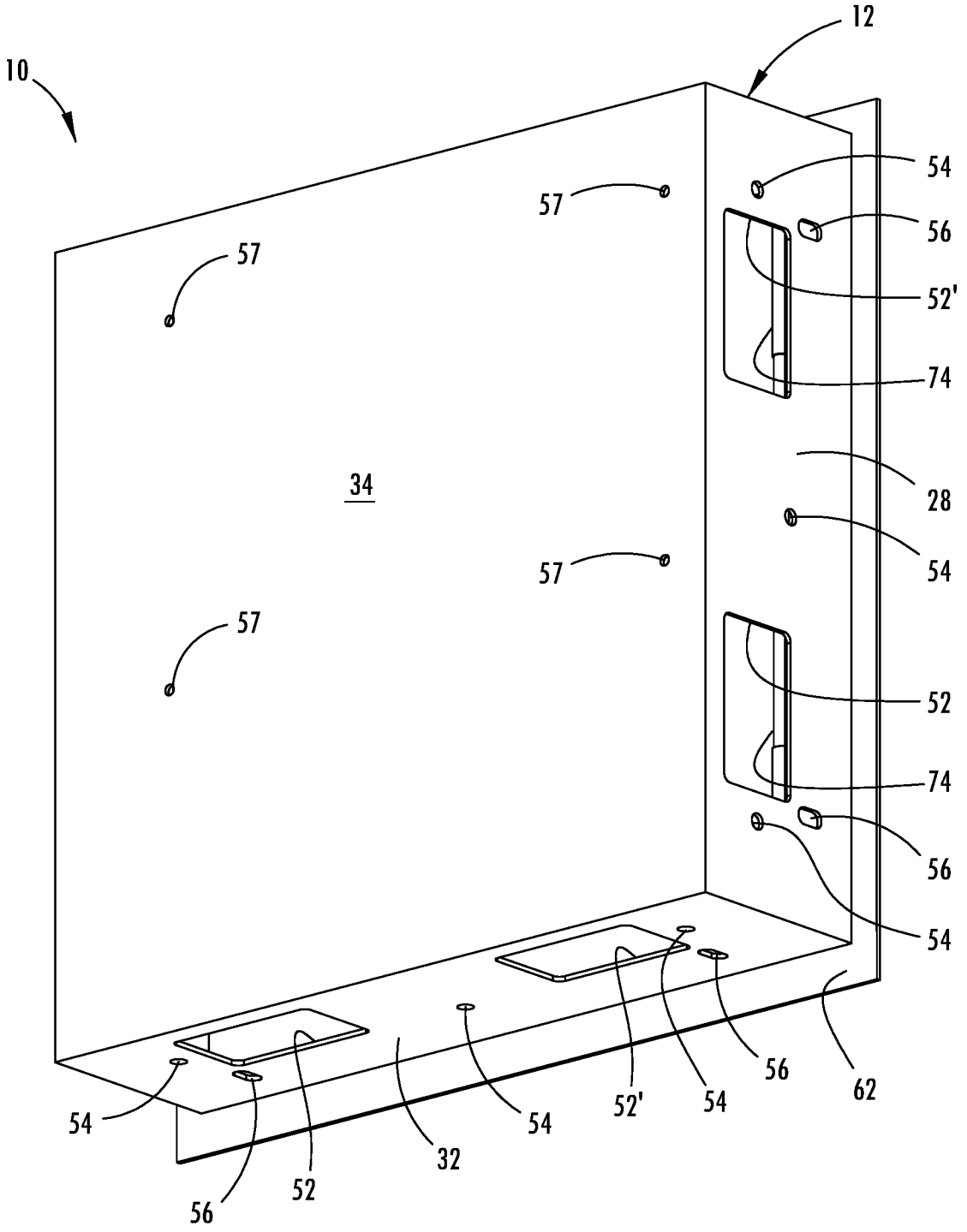
FIG. 4 is a rear perspective view of the wall sleeve seen in FIG. 3 with the access door mounted thereto.

Referring now to FIGS. 3 and 3A, the enclosure 12 is defined by interconnecting a right sidewall 26, a left sidewall 28, a top sidewall 30, a bottom sidewall 32 and a rear wall 34. More particularly, the right sidewall 26 extends between and connects a right end 36 of the top sidewall 30 to a corresponding right end 38 of the bottom sidewall 32. The left sidewall 28 extends between and connects a left end 40 of the top sidewall 26 to a corresponding left end 42 of the bottom sidewall 32. The top sidewall 30 extends between and connects the upper end 44 of the right sidewall 26 to a corresponding upper end 46 of the left sidewall 28. The bottom sidewall 32 extends between and connects the lower end 48 of the right sidewall 26 to a corresponding lower end 50 of the left sidewall 28. Finally, the rear wall 34 extends between and connects together rearward edges of the right sidewall 26, the left sidewall 28, the top sidewall 30 and the bottom sidewall 32. Accordingly, the right sidewall 26, the left sidewall 28, the top sidewall 30, the bottom sidewall 32 and a rear wall 34 cooperatively define the enclosure 12, with the opening 18 of the enclosure 12 being located opposite of the rear wall 34 and being formed by the front edges of each the sidewalls 26, 28, 30 and 32.

Preferably, the enclosure is formed from a single stamped sheet of metal that is bent along the lines of the juncture between the rear wall 34 and each of the sidewalls 26, 28, 30, 32, without the sidewalls being welded to one another to allow for some flexibility when mounting to a wall stud 22. Alternatively, the junctures could be welded or the enclosure 12 could be formed of a molded plastic material of suitable strength and heat resistance.

Each of the sidewalls 26, 28, 30, 32 is provided with one or more cutouts 52, mounting apertures 54 and, optionally, adjustment openings 56.

Preferably, two cutouts, a first cutout 52 and a second cutout 52', are identically provided in each of the sidewalls 26, 28, 30, 32. The cutouts 52 are openings that define passages for the ingress of electrical cable 59 providing power to the electric tankless water heater 24 and for the ingress and egress of inlet and outlet plumbing lines 58 to the electric tankless water heater 24, which is mounted to the rear wall 34 of the wall sleeve 10. As seen in FIGS. 1 and 2, the inlet and outlet plumbing lines 58 are shown passing through the first cutout 52 (an upper cutout) provided in the right sidewall 26 of the enclosure 12. Also, preferably, the cutouts 52, 52' are rectangular in shape and located closer to the rear wall 34 than to the front edges of the sidewalls 26, 28, 30, 32. The rectangular shape of the cutouts 52, 52' allows for maximization of the area of the cutouts 52, 52' relative to the size of the sidewalls 26, 28, 30, 32 and facilitates the ease with which the electrical cable 59 and plumbing lines 58 are routed through the cutouts to the electric tankless water heater 24. Shapes other than rectangular may also be used. Located the cutouts 52, 52' toward the rear wall 34 avoids interference of wallboard of the wall 20 with the electrical cable 59 and plumbing lines 58.

Preferably at least two mounting apertures 54 are identically provided in the sidewalls 26, 28, 30, 32. The mounting apertures 54 are sized to receive screws, nails or other fasteners that are extended through the apertures 54 and into the wall studs 22 or framework of the wall 20 to support the wall sleeve 10 in the wall 20. In the illustrated embodiment, three mounting apertures 54, staggered along the length of the sidewall, are provided.

To allow for securement of the electric tankless water heater 24 in the wall sleeve 10, the rear wall 34 of the enclosure 12 may be provided with apertures 55, corresponding mounting bosses of the heater 24, for receiving metal screws or other fasteners. Alternatively, the apertures 55 may be omitted and the electric tankless water heater 24 mounted via other mechanisms to the wall sleeve 10.

As noted above, adjustment openings 56 may be, optionally, identically provided in each of the sidewalls 26, 28, 30, 32. When provided, two adjustment openings 56, in the form of slots, generally adjacent to the front edges of the sidewalls 26, 28, 30, 32 and extending in the direction of the rear wall 34, are included. The adjustment slots 56 are used to secure the access door 16 to the enclosure 12 when an access door 16 is provided. The position and length of the slots 26, 28, 30, 32 allows for adjustment of the access door 16 relative to the exterior surface of the wall 20 when mounting the access door 16 to the enclosure 12. The access door 16 is preferably mounted to the enclosure 12 by extending screws or bolts through openings in the access door 16, as further discussed below, into and through the adjustment openings 56.

The access door 16, as seen in FIG. 3, is generally formed of three components, a frame 60, a bezel 62 and a cover door 64. The frame 60 is sized to fit into the front opening 14 of the enclosure 12 and, as such its exterior dimensions are slightly smaller than the interior dimensions of the front opening 14. Like the enclosure, the frame 60 includes four frame sidewalls 66 that are each oriented to extend parallel to the sidewalls 26, 28, 30, 32 of the enclosure 12. Provided in each of the frame sidewalls 66 are two adjustment openings 68. These adjustment openings 68 are located so as to coincide with the adjustment openings 56 of the sidewalls 26, 28, 30, 32 and are similarly provided as slots extending toward the rear wall 34. Two opposed members of the frame sidewall 66 may include face flanges 70 that are oriented perpendicular to the adjacent frame sidewalls 66 and extend inward thereof. In the installed position, the face flanges 70 are intended to extend vertically. The face flanges 70 may be unitarily formed with the respective members of the frame sidewalls 66 and bent relative thereto, or may be integrally attached to the respective frame sidewalls 66 by welds or other means.

The bezel 62 is integrally mounted, likewise by welds or other means, about the perimeter of the frame 60 and, like the face flanges 70, are generally oriented perpendicular to the frame sidewalls 66. The exterior dimensions of the bezel 62 are greater than the exterior dimensions of the frame 60. Accordingly, when installed, the bezel 62 rests on the exterior surface of the wall 20 framing the wall sleeve 10 and aesthetically concealing from view the opening 18 in the wall 20. The interior dimensions of the bezel 62 generally correspond with the dimensions of the frame 60 except that the face flanges 70 extend inward of the central opening 72 of the bezel 62.

The cover door 64 is pivotally secured to the one of the face flanges 70 of the frame 60, within the central opening 72 of the bezel 62, by a pivot rod and/or hinges 74. When closed, an edge 76 of the cover door 64, opposite of the hinge 74, engages the corresponding face flange 70 and is prevented from rotating through of the central opening 72 into the enclosure 12. The cover door 64 may additional include a latch 78, such as a rotary or other latch, to secure the cover door in the closed position.

The construction of the wall sleeve 10, as described above, is intended to permit the wall sleeve 10 to be installed within an opening 18 in the wall 20 regardless of the orientation of the wall sleeve 10 relative to the opening 18. In other words, the wall sleeve 10 is omni-directional and does not have upper, lower, left or right sides specific to a mounting orientation. The four identically configured sidewall 26, 28, 30, 32 allow for this omni-directional aspect while ensuring that the electrical cables 59 and plumbing lines 58 always have access into the enclosure 12.

The above description is meant to be illustrative of at least one preferred implementation incorporating the principles of the invention. One skilled in the art will really appreciate that the invention is susceptible to modification, variation and change without departing from the true spirit and fair scope of the invention, as defined in the claims that follow. The terminology used herein is therefore intended to be understood in the nature of words of description and not of limitation.

I claim:

1. A wall sleeve comprising:

a top sidewall;

a bottom sidewall;

a right sidewall, the right sidewall extending between and connecting one end of the top sidewall to a corresponding end of the bottom sidewall;

a left sidewall, the left sidewall extending between and connecting an opposing end of the top sidewall to a corresponding opposing end of the bottom sidewall;

the top sidewall extending between and connecting one end of the right sidewall to a corresponding end of the left sidewall;

the bottom sidewall extending between and connecting an opposing end of the right sidewall to a corresponding opposing end of the left sidewall;

a rear wall, the rear wall extending between and connecting together the top sidewall, the bottom sidewall, the right sidewall, left sidewall to cooperatively define an enclosure, the enclosure having an enclosure opening located opposite of the rear wall;

each of the top sidewall, the bottom sidewall, the right sidewall and the left sidewall having an identical configuration and including portions defining at least one access cutout extending therethrough and including portions defining at least one mounting opening extending therethrough, the mounting openings having an effective diameter smaller than an effective diameter of the access cutouts, the access cutouts being elongated openings through the top, bottom, right and left sidewalls into the enclosure; and the rear wall including a plurality of mounting opening extending therethrough, the mounting openings of the rear wall having an effective diameter smaller than the effective diameter of the access cutouts.

2. The wall sleeve according to claim 1, wherein the portions defining at least one access cutout define at least two access cutouts, a first access cutout and a second access cutout.

3. The wall sleeve according to claim 2, wherein the second access cutouts are identical in size and shape to the first access cutouts.

4. The wall sleeve according to claim 2, wherein the first and second access cutouts are positioned closer to the rear wall than the enclosure opening.

5. The wall sleeve according to claim 1, wherein the access cutouts are positioned closer to the rear wall than the enclosure opening.

6. The wall sleeve according to claim 1, further comprising an access door moveably mounted to the enclosure and moveable between open and closed positions over the enclosure opening of the enclosure.

7. The wall sleeve according to claim 6, wherein the access door includes a frame, a bezel mounted to the frame and a cover door.

8. The wall sleeve according to claim 6, wherein each of the sidewalls of the enclosure includes door mounting openings, the access door being mounted to the enclosure via the door mounting openings.

9. The wall sleeve according to claim 8, wherein the door mounting openings are in the form of slots.

10. The wall sleeve according to claim 9, wherein the slots having a length extend away from the enclosure opening toward the rear wall.

11. The wall sleeve according to claim 1, further comprising a tankless water heater located within the enclosure.

12. The wall sleeve according to claim 11, wherein the tankless water heater includes inlet and outlet plumbing lines, the inlet and outlet plumbing lines being associated with a common one of the access cutouts.

13. The wall sleeve according to claim 12, wherein the inlet and outlet plumbing lines extend through the common one of the access cutouts.

14. A wall sleeve comprising:

a top sidewall;

a bottom sidewall;

a right sidewall, the right sidewall extending between and connecting one end of the top sidewall to a corresponding end of the bottom sidewall;

a left sidewall, the left sidewall extending between and connecting an opposing end of the top sidewall to a corresponding opposing end of the bottom sidewall;

the top sidewall extending between and connecting one end of the right sidewall to a corresponding end of the left sidewall;

the bottom sidewall extending between and connecting an opposing end of the right sidewall to a corresponding opposing end of the left sidewall;

a rear wall, the rear wall extending between and connecting together the top sidewall, the bottom sidewall, the right sidewall, left sidewall to cooperatively define an enclosure, the enclosure having an enclosure opening located opposite of the rear wall;

each of the top sidewall, the bottom sidewall, the right sidewall and the left sidewall having an identical configuration and including portions defining at least one access cutout extending therethrough and including portions defining at least one mounting opening extending therethrough, the mounting openings having an effective diameter smaller than an effective diameter of the access cutouts, the access cutouts being elongated openings through the top, bottom, right and left sidewalls into the enclosure;

the rear wall including a plurality of mounting opening extending therethrough, the mounting openings of the rear wall having an effective diameter smaller than the effective diameter of the access openings; and a tankless water heater located within the enclosure, the tankless water heater including inlet and outlet plumbing lines, the inlet and outlet plumbing lines being associated with a common one of the access cutouts.

15. The wall sleeve according to claim 14, wherein the access cutouts are positioned closer to the rear wall than the enclosure opening.

16. The wall sleeve according to claim 14, further comprising door mounting openings defined in the top, bottom, right and left sidewalls and an access door moveably mounted to the enclosure via door mounting openings and being moveable between open and closed positions, in the closed position the access door covering the enclosure opening, in the open position the enclosure opening being unobstructed by the access door.

* * * * *